US008743039B2

(12) United States Patent
Tai et al.

(10) Patent No.: US 8,743,039 B2
(45) Date of Patent: Jun. 3, 2014

(54) DYNAMIC POLARITY CONTROL METHOD AND POLARITY CONTROL CIRCUIT FOR DRIVING LCD

(75) Inventors: ShihHsin Tai, Gangshan Township, Kaohsiung County (TW); You-Min Yeh, Taipei (TW); Chih-Chieh Yang, Taipei (TW); Hua Wu, Jhubei (TW)

(73) Assignee: Mediatek Inc., Hsin-Chu (TW)

( * ) Notice: Subject to any disclaimer, the term of this patent is extended or adjusted under 35 U.S.C. 154(b) by 623 days.

(21) Appl. No.: 13/030,369

(22) Filed: Feb. 18, 2011

(65) Prior Publication Data

US 2012/0062610 A1 Mar. 15, 2012

Related U.S. Application Data

(60) Provisional application No. 61/383,024, filed on Sep. 15, 2010.

(51) Int. Cl.
*G09G 5/10* (2006.01)
*G09G 3/36* (2006.01)

(52) U.S. Cl.
USPC ..... 345/89; 345/690

(58) Field of Classification Search
None
See application file for complete search history.

(56) References Cited

U.S. PATENT DOCUMENTS

| | | | | |
|---|---|---|---|---|
| 7,109,964 | B2 | 9/2006 | Pai | |
| 7,362,299 | B2 | 4/2008 | Hosotani | |
| 7,551,157 | B2 | 6/2009 | Tanaka et al. | |
| 7,893,910 | B2 | 2/2011 | Feng | |
| 8,188,952 | B1 * | 5/2012 | Orlando et al. | 345/87 |
| 2005/0093806 | A1 * | 5/2005 | Hosotani | 345/96 |
| 2010/0053147 | A1 * | 3/2010 | Choi et al. | 345/214 |
| 2011/0037760 | A1 * | 2/2011 | Kim et al. | 345/214 |
| 2011/0261091 | A1 * | 10/2011 | Nose | 345/690 |

FOREIGN PATENT DOCUMENTS

| | | | |
|---|---|---|---|
| CN | 1577420 | | 2/2005 |
| CN | 1577420 | A * | 2/2005 |
| TW | 200408862 | | 6/2004 |
| TW | 200828219 | | 7/2004 |

OTHER PUBLICATIONS

English language translation of abstract of CN 1577420 (published Feb. 9, 2005).

* cited by examiner

*Primary Examiner* — Amare Mengistu
*Assistant Examiner* — Jennifer Zubajlo
(74) *Attorney, Agent, or Firm* — McClure, Qualey & Rodack, LLP

(57) ABSTRACT

A dynamic polarity control method for driving an LCD is provided. Gray level information is obtained, which indicates gray levels of dots in an image to be displayed. The gray level information is applied to each of a plurality of polarity patterns to obtain a plurality of combined patterns, wherein each of the polarity patterns has an individual polarity distribution. The gray levels of each of the combined patterns are summed up. A final pattern is selected from the plurality of polarity patterns according to the summed results, to drive the LCD for displaying the image.

20 Claims, 8 Drawing Sheets

| | | | |
|---|---|---|---|
| + | − | + | − |
| − | + | − | + |
| + | − | + | − |
| − | + | − | + |

FIG. 3A

| | | | |
|---|---|---|---|
| + | − | + | − |
| + | − | + | − |
| − | + | − | + |
| − | + | − | + |

FIG. 3B

| | | | |
|---|---|---|---|
| + | − | + | − |
| + | − | + | − |
| + | − | + | − |
| + | − | + | − |

FIG. 3C

| | | | |
|---|---|---|---|
| + | + | − | − |
| − | − | + | + |
| + | + | − | − |
| − | − | + | + |

FIG. 3D

| | | | |
|---|---|---|---|
| + | + | − | − |
| + | + | − | − |
| − | − | + | + |
| − | − | + | + |

FIG. 3E

| | | | |
|---|---|---|---|
| + | + | − | − |
| + | + | − | − |
| + | + | − | − |
| + | + | − | − |

FIG. 3F

| | | | |
|---|---|---|---|
| 50 | 250 | 50 | 250 |
| 200 | 100 | 200 | 100 |
| 200 | 200 | 100 | 100 |
| 200 | 200 | 100 | 100 |

FIG. 5

(Vb=-600)

| | | | |
|---|---|---|---|
| +50 | -250 | +50 | -250 |
| -200 | +100 | -200 | +100 |
| +200 | -200 | +100 | -100 |
| -200 | +200 | -100 | +100 |

FIG. 6A (Vb=-200)

| | | | |
|---|---|---|---|
| +50 | -250 | +50 | -250 |
| +200 | -100 | +200 | -100 |
| -200 | +200 | -100 | +100 |
| -200 | +200 | -100 | +100 |

FIG. 6B (Vb=-200)

| | | | |
|---|---|---|---|
| +50 | -250 | +50 | -250 |
| +200 | -100 | +200 | -100 |
| +200 | -200 | +100 | -100 |
| +200 | -200 | +100 | -100 |

FIG. 6C (Vb=0)

| | | | |
|---|---|---|---|
| +50 | +250 | -50 | -250 |
| -200 | -100 | +200 | +100 |
| +200 | +200 | -100 | -100 |
| -200 | -200 | +100 | +100 |

FIG. 6D (Vb=-400)

| | | | |
|---|---|---|---|
| +50 | +250 | -50 | -250 |
| +200 | +100 | -200 | -100 |
| -200 | -200 | +100 | +100 |
| -200 | -200 | +100 | +100 |

FIG. 6E (Vb=+400)

| | | | |
|---|---|---|---|
| +50 | +250 | -50 | -250 |
| +200 | +100 | -200 | -100 |
| +200 | +200 | -100 | -100 |
| +200 | +200 | -100 | -100 |

FIG. 6F

DYNAMIC POLARITY CONTROL METHOD AND POLARITY CONTROL CIRCUIT FOR DRIVING LCD

CROSS REFERENCE TO RELATED APPLICATIONS

This application claims the benefit of U.S. Provisional Application No. 61/383,024, filed on Sep. 15, 2010, the entirety of which is incorporated by reference herein.

BACKGROUND

The present invention is related to a dynamic polarity control method for driving a liquid crystal display (LCD), and more particularly to a content-based dynamic polarity control method for an LCD.

An LCD is constructed by an array of liquid crystal (LC) cells. FIG. 1 shows a schematic illustrating a panel structure of an LCD, wherein each LC cell 10 is coupled to a source driver 20, a gate driver 30 and a common voltage Vcom which is a reference voltage for the LCD. In FIG. 1, a timing controller (TCON) 40 controls the gate driver 30 to provide a gate voltage $V_G$ for turning on the LC cells 10 in each row line, and the timing controller 40 controls the source driver 20 to charge the LC cells 10 in each column line with a driving voltage $V_D$. The gray level of a pixel or a dot indicated by the LC cell 10 is determined according to an absolute voltage difference between the driving voltage $V_D$ and the common voltage Vcom. Referring to FIG. 2, a relationship between the driving voltage $V_D$ corresponding to various gray levels and the common voltage Vcom is shown, wherein the polarity of the driving voltage $V_D$ can be either positive or negative when compared with the common voltage Vcom. For example, the signals V1(+) to V255(+) indicating the driving voltage $V_D$ with various voltage levels for gray levels 1 to 255, are larger than the common voltage Vcom, and the signals V1(−) to V255(−) indicating the driving voltage $V_D$ with the voltage levels for gray levels 1 to 255, are smaller than the common voltage Vcom. If most of the LC cells 10 are charged by the driving voltage $V_D$ with positive polarity, a positive voltage bias is induced in the common voltage Vcom, and vice versa. The voltage bias induced in the common voltage Vcom will cause the phenomenon of color shift and flicker. Thus, controlling the number of LC cells 10 driven by the driving voltage $V_D$ with positive polarity and negative polarity is important to keeping the common voltage Vcom at a neutral level.

BRIEF SUMMARY OF THE INVENTION

Dynamic polarity control methods and polarity control circuits for an LCD are provided. An embodiment of a dynamic polarity control method for driving an LCD is provided. Gray level information is obtained, which indicates gray levels of dots in an image to be displayed. The gray level information is applied to each of a plurality of polarity patterns to obtain a plurality of combined patterns, wherein each of the polarity patterns has an individual polarity distribution. The gray levels of each of the combined patterns are summed up. A final pattern is selected from the plurality of polarity patterns according to the summed results, to drive the LCD for displaying the image.

Furthermore, another embodiment of a dynamic polarity control method for driving an LCD is provided. Gray level information is obtained, which indicates gray levels of dots in an image to be displayed. A final pattern is selected from a plurality of polarity patterns according to the gray level information, to drive the LCD for displaying the image, wherein each polarity pattern has an individual polarity distribution.

Moreover, an embodiment of a polarity control circuit for driving an LCD is provided. The polarity control circuit comprises a combination unit, an accumulator and a selector. The combination unit receives gray levels of dots in an image and sequentially provides a gray level value with a polarity in response to the received gray level and a polarity control signal, wherein the polarity control signal is provided according to one of a plurality of polarity patterns and each polarity pattern has an individual polarity distribution. The accumulator receives the gray level value provided by the combination unit, and accumulates the received gray level value to generate an accumulation result corresponding to each of the plurality of polarity patterns. The selector selects a final pattern from the plurality of polarity patterns according to the accumulation results to drive the LCD for displaying the image.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein:

FIG. 3A to FIG. 3F show the polarity patterns of several driving methods applied to LC cells of an LCD, respectively;

FIG. 5 shows a 4×4 table illustrating gray level information of 4×4 dots in an image;

FIG. 6A to FIG. 6F show the combined patterns by applying the gray level information of FIG. 5 to the polarity patterns of FIG. 3A to FIG. 3F, respectively;

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

FIG. 3A to FIG. 3F show the polarity patterns of several driving methods applied to LC cells of an LCD, respectively. The polarity patterns of FIGS. 3A-3F have different polarity distributions, and each polarity pattern of FIGS. 3A-3F comprises half of the dots with positive polarity and half of the dots with negative polarity in each row line. For example, the polarity of driving voltages applied to the LC cells in the same row are inverted every one dot in FIGS. 3A-3C, and the polarity of driving voltages applied to the LC cells in the same row are inverted every two dots in FIGS. 3D-3F. The polarity of driving voltages applied to the LC cells in the same column are inverted every one dot in FIGS. 3A and 3D, and the polarity of driving voltages applied to the LC cells in the same column are inverted every two dots in FIGS. 3B and 3E. The polarity of driving voltages applied to the LC cells in the same column is identical in FIGS. 3C and 3F. The invention discloses a dynamic polarity control method which chooses one from various polarity patterns (e.g. FIG. 3A-FIG. 3F) according to content in an image to be displayed, to drive the LC cells. It is noted that the 4×4 dots polarity patterns in FIGS. 3A-3F are used as an example for explanations, and are not meant to be a limitation of the present invention. Specifically, the amount of the dots with a positive polarity and the amount of the dots with a negative polarity are the same in the polarity patterns. Furthermore, the polarity distributions of the polarity patterns can be designed to conform to various polarity inversions, such as frame inversion, line inversion and dot inversion and combinations thereof. Any alternative design without departing from the spirit of the present invention falls within the scope of the present invention.

Figure 4:
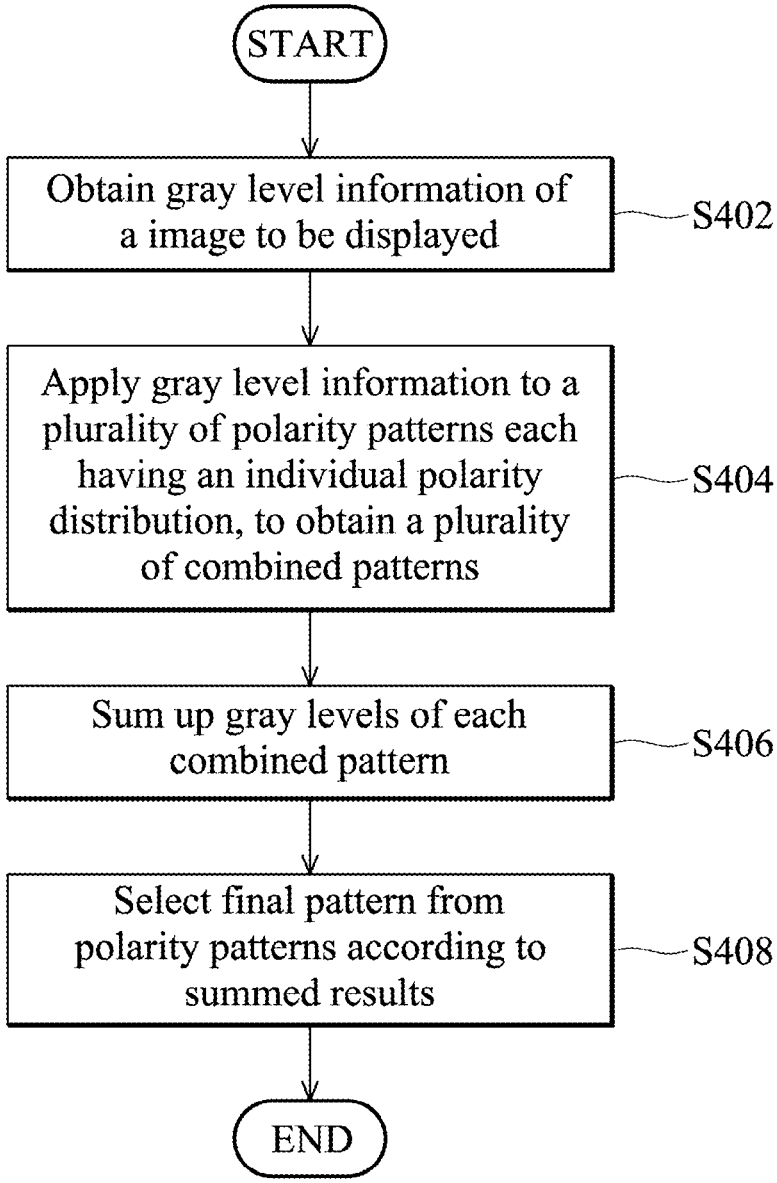
FIG. 4 shows a dynamic polarity control method for driving an LCD according to an embodiment of the invention.

FIG. 4 shows a dynamic polarity control method for driving an LCD according to an embodiment of the invention. First, in step S402, gray level information of an image to be displayed is obtained, wherein the gray level information comprises gray level of each dot in the image. For example, FIG. 5 shows a 4×4 table illustrating gray level information of 4×4 dots in an image. Next, in step S404, the gray level information is applied to a plurality of polarity patterns (e.g. FIG. 3A-FIG. 3F), wherein each polarity pattern has an individual polarity distribution, thus a plurality of combined patterns is obtained. For example, FIG. 6A to FIG. 6F show the combined patterns by applying the gray level information of FIG. 5 to the polarity patterns of FIG. 3A to FIG. 3F, respectively. Next, in step S406 of FIG. 4, the gray levels of each combined pattern are summed up to obtain a corresponding voltage bias Vb. Taking FIG. 6A as an example, FIG. 6A shows grey levels of a combined pattern by applying the gray level information of FIG. 5 to the polarity pattern of FIG. 3A. Therefore, the voltage bias Vb of FIG. 6A may be calculated by summing up the gray levels thereof as the following equation:

$$Vb=+50-250+50-250-200+100-200+100+200-200+100-100-200+200-100+100=-600.$$

Furthermore, the voltage biases Vb of FIGS. 6B-6F can be calculated in the same way. Please note that when two dots are driven by the same gray level but with opposite polarities, the voltage biases induced in the common voltage Vcom by the two dots can be cancelled. Therefore, the voltage bias Vb is a voltage bias induced in the common voltage Vcom for the LC cells when the corresponding polarity pattern is used to drive the LC cells, as described above. Next, in step S408 of FIG. 4, a final pattern is selected from the polarity patterns according to the voltage biases Vb of the combined patterns. In one embodiment, the final pattern is a polarity pattern corresponding to the combined pattern with a voltage bias Vb having a minimum absolute value, for example, the voltage bias Vb of the combined pattern shown in FIG. 6D is 0, which represents that no voltage bias is induced in the common voltage Vcom for the dots, and the polarity pattern shown in FIG. 3D corresponding to the combined pattern shown in FIG. 6D may be selected as the final pattern in the embodiment. In other words, a driving voltage $V_D$ corresponding to the combined pattern with the voltage bias Vb having the minimum absolute value is close to the common voltage Vcom for the LCD, thus eliminating or reducing the phenomenon of color shift and flicker.

Furthermore, besides selecting the polarity pattern corresponding to the combined pattern with the voltage bias Vb having the minimum absolute value as the final pattern, other rules may be used to select the final pattern from the polarity patterns. In one embodiment, the polarity patterns corresponding to the combined patterns with the voltage bias Vb having an absolute value smaller than a threshold value, may be considered as a candidate for the final pattern, and then the final pattern may be selected from the candidates according to a look-up table (LUT). For example, the look-up table records the previous selected final pattern or the number of times that each polarity pattern has been selected as the final pattern previously. Taking the polarity patterns of FIGS. 3A-3C and their combined patterns of FIGS. 6A-6C as an example, if the threshold value is 250, the polarity patterns of FIG. 3B and FIG. 3C respectively corresponding to the combined patterns of FIG. 6B and FIG. 6C may be considered as an candidate for the final pattern, and then one of the two polarity patterns may be selected as the final pattern according to which is the previous selected final pattern or the pattern that is frequently used as the final pattern. It is to be noted that the threshold value and the look-up table can be designed according to various applications.

Figure 7:
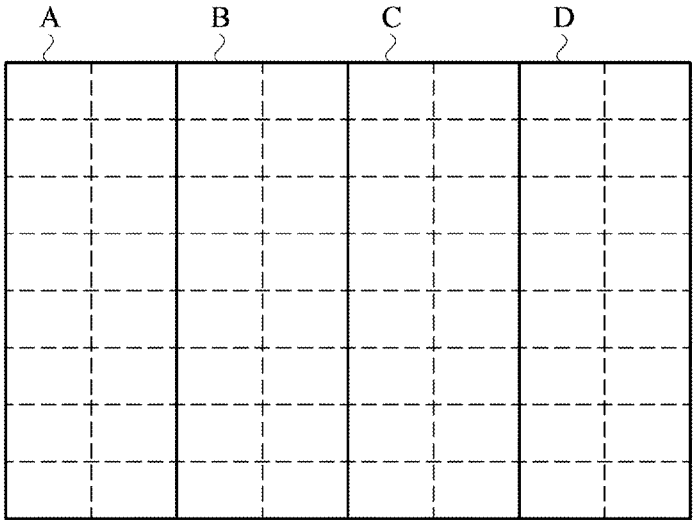
FIG. 7 shows an example illustrating a polarity pattern with four parts A to D each comprising a plurality of dots.

In some LCDs, the screen is composed of several panels, and each panel has different polarity properties due to manufacture technology. Thus, the LC cells applied by positive driving voltage may cause positive voltage bias Vb in one panel but negative voltage bias Vb in another panel. Therefore, in order to drive the LCD, the polarity patterns may be divided into several parts, wherein each part is used to drive an individual panel. The amount of the parts with a positive polarity and the amount of the parts with a negative polarity are the same in the polarity patterns, wherein the polarity of each part is adjustable and each part comprises the dots with same polarity. Referring to FIG. 7, FIG. 7 shows an example illustrating a polarity pattern with four parts A to D, wherein each of the parts A to D comprises a plurality of dots. In FIG. 7, the polarity of each part can be assigned to be positive or negative. For example, if the parts B and C are with opposite polarity to the parts A and D, the polarity of panel B and C may be assigned a negative polarity, and then the voltage bias Vb corresponding to the polarity pattern in FIG. 7 may be calculated by the following equation:

$$Vb=+\text{sum}A-\text{sum}B-\text{sum}C+\text{sum}D,$$

where sumA, sumB, sumC and sumD represent the sum of the gray level of the dots in the parts A, B, C and D, respectively.

In one embodiment, only the dots in a region of interest (ROI) of an image are taken into consideration for determining the final pattern. In other words, only the gray levels of the dots in the ROI will be used to calculate the voltage bias Vb while the dots outside of the ROI will be ignored.

Figure 1:
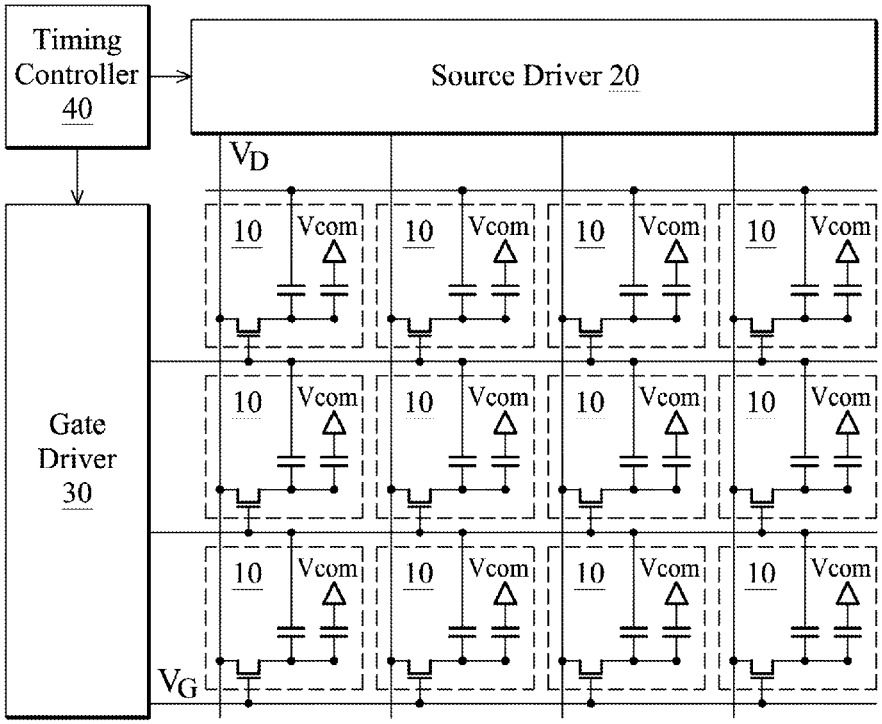
FIG. 1 (RELATED ART)
FIG. 1 shows a schematic illustrating a panel structure of an LCD.
Figure 2:
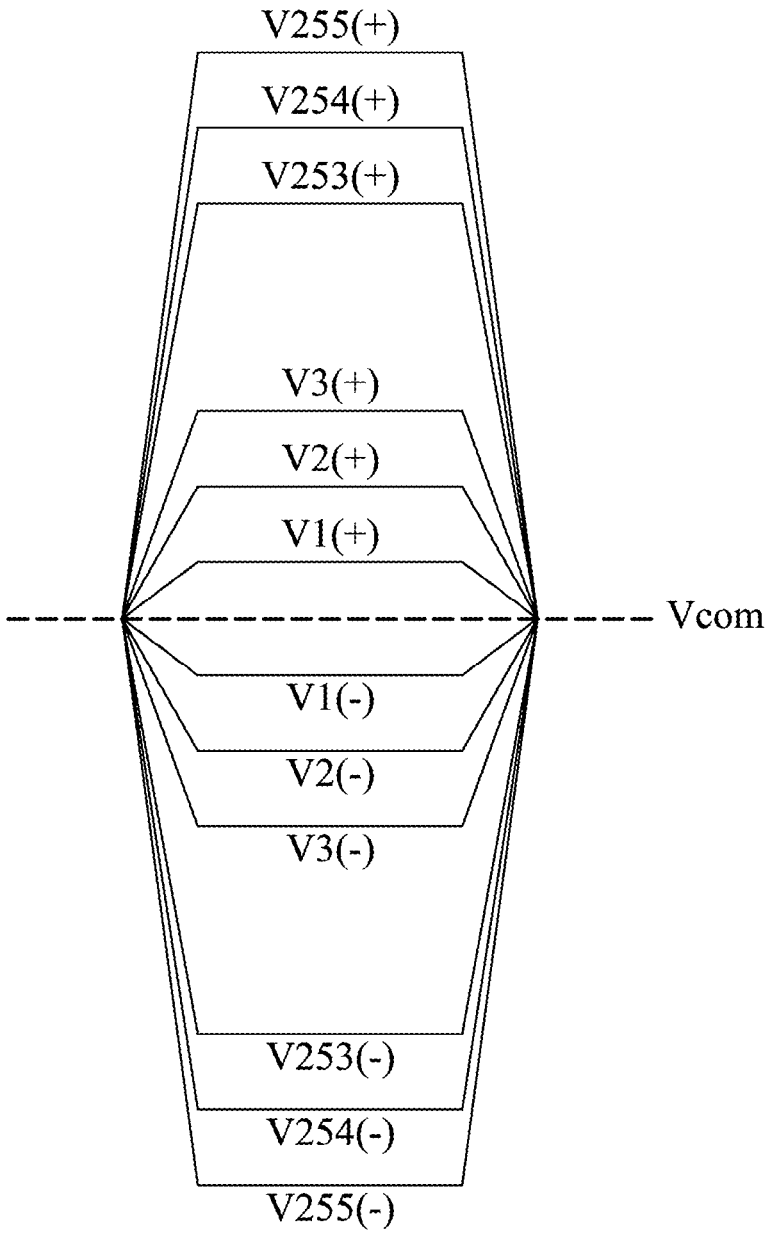
FIG. 2 (RELATED ART)
FIG. 2 shows a relationship between the driving voltage $V_D$ corresponding to various gray levels and the common voltage Vcom.
Figure 8:
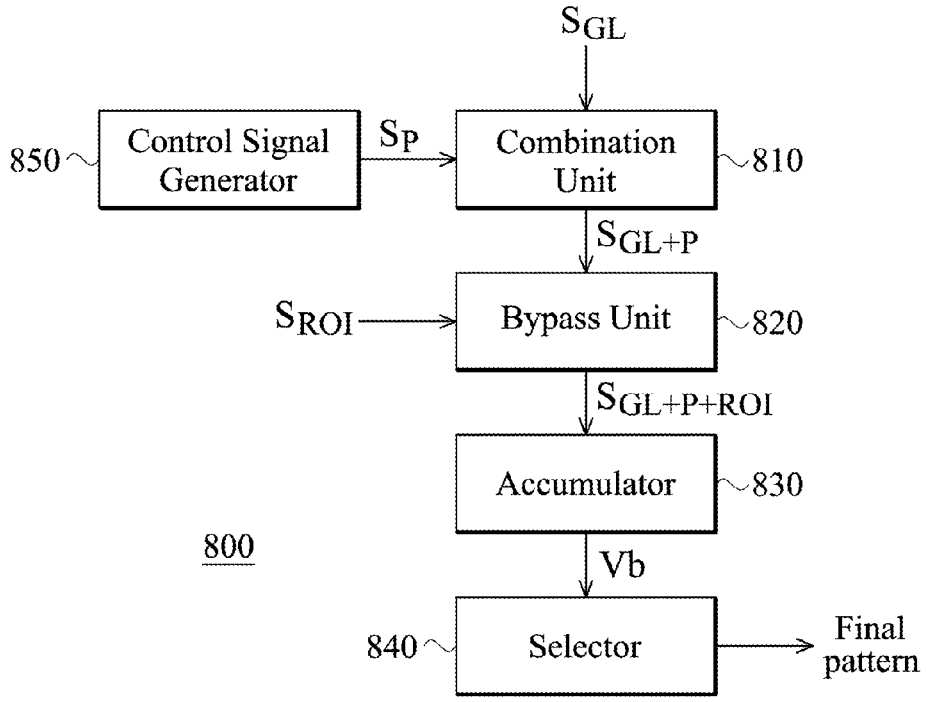
FIG. 8 shows an exemplary hardware architecture illustrating a polarity control circuit according to an embodiment of the invention.

FIG. 8 shows an exemplary hardware architecture illustrating a polarity control circuit 800 according to an embodiment of the invention. In an LCD, the polarity control circuit 800 may be implemented in a timing controller (e.g. TCON 40 of FIG. 1). The polarity control circuit 800 comprises a combination unit 810, a bypass unit 820, an accumulator 830, a selector 840 and a control signal generator 850. For an image to be displayed on the LCD, the gray level $S_{GL}$ of each dot in the image will be received by the combination unit 810 in order. Simultaneously, the control signal generator 850 provides a polarity control signal Sp in response to the gray level $S_{GL}$ received by the combination unit 810 according to one of a plurality of polarity patterns, wherein each polarity pattern has an individual polarity distribution. After receiving the polarity control signal $S_P$ and the gray level $S_{GL}$, the combination unit 810 may apply a polarity to the gray level $S_{GL}$ according to the polarity control signal $S_P$, to generate a gray level value $S_{GL+P}$ and provide the gray level value $S_{GL+P}$ to the bypass unit 820. In the embodiment, the combination unit 810 is used to apply gray level information of an image to each of the polarity patterns, so as to obtain a corresponding combined pattern, respectively. Next, if a ROI signal San indicates that the gray level value $S_{GL+P}$ is a gray level of a dot located in a ROI of an image, the bypass unit 820 may provide the gray level value $S_{GL+P}$ as a signal $S_{GL+P+ROI}$, i.e. directly pass the gray level value $S_{GL+P}$ to the accumulator 830. On the contrary, if the ROI signal San indicates that the gray level value $S_{GL+P}$ is a gray level of a dot located outside of the ROI in the image, the bypass unit 820 may provide the signal $S_{GL+P+ROI}$ with a zero value to the accumulator 830. Next, the accumulator 830 may accumulate the signal $S_{GL+P+ROI}$ to obtain an accumulation result corresponding to the one of the polarity patterns, wherein the accumulation result represents the voltage bias Vb, as described above. After the accumulation result corresponding to the one of the polarity patterns is obtained, the combination unit 810, the control signal generator 850, the bypass unit 820 and the accumulator 830 may perform the operations described above again, to obtain the accumulation result corresponding to another polarity pattern until the accumulation results are obtained for all polarity patterns. In one embodiment, the combination unit 810, the bypass unit 820 and the accumulator 830 may be duplicated for the plurality of polarity patterns, so as to obtain the accumulation results at the same time.

After obtaining the total accumulation results of the polarity patterns, the selector 840 may select a final pattern from the polarity patterns according to the accumulation results, wherein each accumulation result corresponds to an individual polarity pattern. Similarly, the final pattern may be a polarity pattern with a minimum absolute accumulation result among the plurality of polarity patterns. Furthermore, the selector 840 selects the final pattern further according to a specific rule (e.g. the threshold value and the look-up table described above).

According to the invention, a final pattern can be located among various polarity patterns based on content of an image to be displayed, thus eliminating or reducing the phenomenon of color shift and flicker.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dynamic polarity control method for driving a liquid crystal display (LCD), comprising:

obtaining gray level information which indicates gray levels of dots in an image to be displayed;

applying the gray level information to each of a plurality of polarity patterns to obtain a plurality of combined patterns, wherein each of the polarity patterns has an individual polarity distribution;

summing up the gray levels of each of the combined patterns; and selecting a final pattern from the plurality of polarity patterns according to the summed results and at least one of a plurality of selectable selection rules, to drive the LCD for displaying the image.

2. The dynamic polarity control method as claimed in claim 1, wherein the final pattern corresponds to a combined pattern having a minimum summed result among the plurality of combined patterns.

3. The dynamic polarity control method as claimed in claim 1, wherein the step of selecting the final pattern from the plurality of polarity patterns further comprises:

setting a threshold value; and selecting the final pattern from the plurality of polarity patterns according to a specific rule among the plurality of selection rules when more than one summed result has an absolute value smaller than the threshold value.

4. The dynamic polarity control method as claimed in claim 3, wherein the final pattern is selected according to a previous final pattern.

5. The dynamic polarity control method as claimed in claim 1, wherein the step of summing up the gray levels of each of the combined patterns further comprises:

summing up the gray levels of the dots located in a specific region of the plurality of combined patterns, respectively, and the step of selecting the final pattern from the plurality of polarity patterns further comprises:

selecting the final pattern from the plurality of polarity patterns according to the summed results corresponding to the specific region in the plurality of combined patterns, to drive the LCD for displaying the image.

6. The dynamic polarity control method as claimed in claim 1, wherein the amount of the dots with a positive polarity and the amount of the dots with a negative polarity are the same in each of the polarity patterns.

7. A dynamic polarity control method for driving a liquid crystal display (LCD), comprising:

obtaining gray level information which indicates gray levels of dots in an image to be displayed; and selecting a final pattern from a plurality of polarity patterns according to the gray level information and at least one of a plurality of selectable selection rules, to drive the LCD for displaying the image, wherein each polarity pattern has an individual polarity distribution.

8. The dynamic polarity control method as claimed in claim 7, further comprising:

applying the gray level information to each of the plurality of polarity patterns to obtain a plurality of combined patterns; and summing up the gray levels of each of the combined patterns.

9. The dynamic polarity control method as claimed in claim 8, wherein the step of selecting the final pattern from the plurality of polarity patterns further comprises:

selecting the final pattern from the plurality of polarity patterns according to the summed results.

10. The dynamic polarity control method as claimed in claim 9, wherein the final pattern corresponds to a combined pattern having a minimum summed result among the plurality of combined patterns.

11. The dynamic polarity control method as claimed in claim 9, wherein the step of selecting the final pattern from the plurality of polarity patterns according to the summed results further comprises:

setting a threshold value; and selecting the final pattern from the plurality of polarity patterns according to a specific rule among the plurality of selection rules when more than one summed result has an absolute value smaller than the threshold value.

12. The dynamic polarity control method as claimed in claim 11, wherein the final pattern is selected according to a previous final pattern.

13. The dynamic polarity control method as claimed in claim 8, wherein the step of summing up the gray levels of each of the combined patterns further comprises:

summing up the gray levels of the dots located in a specific region of the plurality of combined patterns, respectively, and the step of selecting the final pattern from the plurality of polarity patterns further comprises:

selecting the final pattern from the plurality of polarity patterns according to the summed results corresponding to the specific region in the plurality of combined patterns, to drive the LCD for displaying the image.

14. The dynamic polarity control method as claimed in claim 7, wherein the amount of the dots with a positive polarity and the amount of the dots with a negative polarity are the same in each of the polarity patterns.

15. A polarity control circuit for driving an LCD, comprising:

a combination unit, receiving gray levels of dots in an image and sequentially providing a gray level value with a polarity in response to the received gray level and a polarity control signal, wherein the polarity control signal is provided according to one of a plurality of polarity patterns and each polarity pattern has an individual polarity distribution;

an accumulator, receiving the gray level value provided by the combination unit and accumulating the received gray level value to generate an accumulation result corresponding to each of the plurality of polarity patterns; and a selector, selecting a final pattern from the plurality of polarity patterns according to the accumulation results and at least one of a plurality of selectable selection rules to drive the LCD for displaying the image.

16. The polarity control circuit as claimed in claim 15, further comprising:

a control signal generator, providing the polarity control signal in response to the gray level received by the combination unit according to the one of the plurality of polarity patterns.

17. The polarity control circuit as claimed in claim 15, wherein the final pattern has a minimum accumulation result among the plurality of polarity patterns.

18. The polarity control circuit as claimed in claim 15, wherein the selector selects the final pattern from the plurality of polarity patterns according to a specific rule among the plurality of selection rules when more than one accumulation result has an absolute value smaller than a threshold value.

19. The polarity control circuit as claimed in claim 15, further comprising:

a bypass unit, replacing the gray level value provided by the combination unit with a zero value and providing the zero value to the accumulator when the gray level value provided by the combination unit is a gray level of a dot located outside of a specific region of the one of the plurality of polarity patterns.

20. The polarity control circuit as claimed in claim 15, wherein each of the polarity patterns is divided into a plurality of parts, and the amount of the plurality of parts is even and each part comprises the dots with same polarity.

* * * * *